United States Patent [19]

DeLuca

[11] Patent Number: 4,605,882

[45] Date of Patent: Aug. 12, 1986

[54] ELECTRONIC JEWELRY SIMULATING NATURAL FLICKERING LIGHT

[76] Inventor: Frederick P. DeLuca, 3520 Jewel Dr., Ames, Iowa 50010

[21] Appl. No.: 627,289

[22] Filed: Jul. 2, 1984

[51] Int. Cl.[4] ..... F21L 15/08; H05B 37/02

[52] U.S. Cl. ..... 315/158; 315/76; 315/307; 315/360; 315/DIG. 4; 362/104; 362/810

[58] Field of Search ..... 362/104, 810, 811, 806; 315/158, 76, 360, 363, DIG. 4, 307

[56] References Cited

U.S. PATENT DOCUMENTS 3,416,032 12/1968 Jahns et al. ..... 315/DIG. 4
3,521,049 7/1970 Young ..... 362/104
4,008,416 2/1977 Nakasone ..... 315/DIG. 4
4,296,459 10/1981 DeLuca ..... 362/104
4,459,645 7/1984 Glatter ..... 362/104

*Primary Examiner*—Harold Dixon
*Attorney, Agent, or Firm*—Zarley, McKee, Thomte, Voorhees & Sease

[57] ABSTRACT

The light-emitting electronic jewelry of the invention includes a base item of jewelry having a light emitter and at least one light sensor mounted thereon and connected in an electrical circuit with other circuit elements which coact to intermittently interrupt the emission of light from the light emitter in response to changes in ambient light intensity sensed by the light sensor. Preferably a pair of light sensors are connected in series with the output to the light producing circuit taken between them.

20 Claims, 16 Drawing Figures

ELECTRONIC JEWELRY SIMULATING NATURAL FLICKERING LIGHT

BACKGROUND OF THE INVENTION

The present invention is directed generally to light-emitting electronic jewelry and more specifically to articles of electronic jewelry which simulate the natural flickering of light from faceted gem stones.

Electronic light-emitting jewelry has previously been known. See for example this inventor's own prior U.S. Pat. No. 4,296,459 and the reference cited therein. Whereas the jewelry of this inventor's prior patent is believed to have been a significant advance in the art, additional improvements have been made which are believed to resolve problems associated with that and other known prior electronic jewelry.

One such problem relates to providing a source for a randomly pulsing input signal. Electronic clock pulses are too regular to simulate natural flickering light and known motion detectors lack sensitivity.

Whereas light sensors are previously known, these are generally fixedly mounted and are dependent for operation upon changing ambient light intensities; either naturally as from day to night changes or artificially as from the on-off control of artificial light sources. Thus the popular usage of light sensors is not well-suited for electronic jewelry.

Other problems relate to the limited sensitivity of light sensors and the problem of maintaining sensitivity over a wide range of light intensities.

Finally, if light of a fixed intensity is emitted from the jewelry, this light will therefore appear too bright or too dim and therefore artificial under conditions of varying ambient light intensity.

These problems are believed to be resolved by the improved light-emitting jewelry of the present invention.

Accodingly, a primary object of the present invention is to provide light-emitting electronic jewelry which is operative to simulate natural flickering light.

Another object is to provide such jewelry wherein the input signal for the circuit is produced by a light sensor.

A related object is to provide such jewelry with a pair of light sensors arranged for sensing light intensities from different directions.

Another object is to provide such jewelry with a combination of circuit elements which are sufficiently sensitive that an amplification stage is unnecessary.

Another object is to provide such jewelry with a circuit capable of automatic adjustments for maintaining high sensitivity over a very wide range of light intensities.

Another object is to provide such jewelry with a circuit which results in minimal current drain on the battery supply.

Another object is to provide such jewelry which is capable of effective operation on a low-voltage battery source.

Another object is to provide such jewelry which is uncomplicated in construction, attractive and natural in appearance and efficient in operation.

SUMMARY OF THE INVENTION

The light-emitting electronic jewelry of the invention includes a base item of jewelry having a light emitter and at least one light sensor mounted thereon and connected in an electrical circuit with other circuit elements which coact to intermittently interrupt the emission of light from the light emitter in response to changes in ambient light intensity sensed by the light sensor.

In a preferred embodiment, two light sensors respond to the different ambient light intensities which fall on the sensors from different directions. The light intensities both indoors and outdoors are almost always different in different directions. The detectors produce an irregularly rising and falling electrical signal which corresponds to the rising and falling ambient light intensities "seen" by the light sensors as the wearer moves.

The irregular signal from the light sensors is changed into a sharply rising and falling signal by a Schmitt trigger for input to a multi-vibrator. The Schmitt trigger produces a snapping on-off action much like an ordinary hand-operated switch. Without this snapping action, the multi-vibrator, at certain light intensities, would tend to go on and off so fast that the light source would appear to be continuously on for a few seconds, which is much too long, as opposed to the desired several milliseconds.

The one-shot multi-vibrator responds to the sharply falling signal from the Schmitt trigger by producing a narrow pulse, several milliseconds wide, at its output, and then waiting for another sharply falling signal from the Schmitt trigger.

An auto-dimmer senses ambient light and, in conjunction with the pulse-width from the multi-vibrator, controls the current through a driver transistor which activates the light emitter for the duration of the pulse-width.

The result is a short pulse or flicker of light every time the light sensors detect a change in light intensities. The overall effect is rather elegant because the flickering is random and dependent on the light intensities falling on the sensors, which is comparable to the dependence of natural flickering of faceted gem stones on the intensities of light falling on the gem stones. The auto-dimmer adds an important quality by reducing the intensity of the emitted light when ambient light is dim and increasing the intensity of the emitted light as the ambient light becomes brighter. Thus, the appearance is never too bright and bold, and can operate effectively in a wider range of light intensities.

DESCRIPTION OF THE PREFERRED EMBODIMENTS

Figure 1:
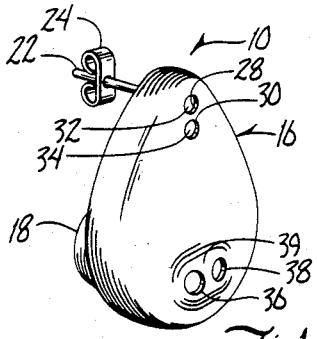
FIG. 1 is a perspective view of a light-emitting electronic earring.
Figure 2:
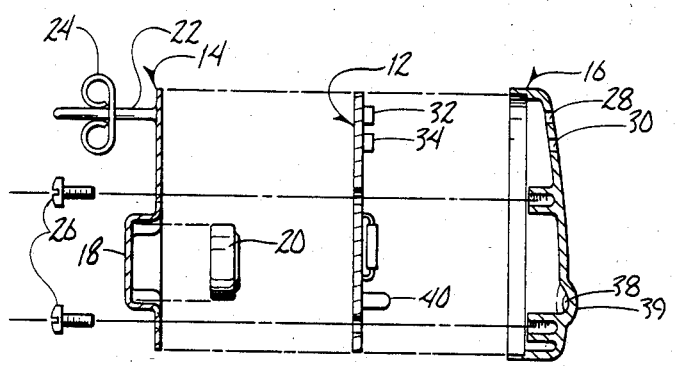
FIG. 2 is an exploded side sectional view of the earring of FIG. 1.
Figure 3:
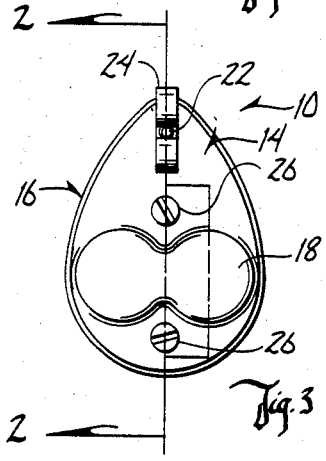
FIG. 3 is a rear elevational view of the earring of FIG. 1.

The light-emitting electronic jewelry of the present invention is illustrated in FIGS. 1–4 as embodied within an earring 10. As seen in FIG. 2, the earring, or base item of jewelry, includes a printed circuit board 12 sandwiched between a back piece 14 and a front cover 16. Back piece 14 includes a recess 18 for carrying the batteries 20 which power the circuit of the device. Back piece 14 is also provided with a conventional post 22, clasp 24 and screws 26 for securing the parts together.

Figure 4:
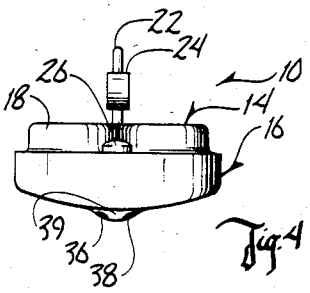
FIG. 4 is a bottom view of the earring of FIG. 1.

The front cover 16 includes two apertures 28 and 30 which are positioned for registration, respectively with a light emitter such as a light-emitting diode 32 and a light sensor such as phototransistor 34 on the printed circuit board 12. Another pair of apertures 36 and 38 are arranged on a mount 39 so as to be inclined approximately 65° relative to one another, as seen in FIG. 4. These apertures are positioned for registration with a pair of light sensors 40 which are similarly inclined relative to one another for sensing light from different directions.

The operation of the earring is described below in connection with the circuit description. This circuit is applicable to all types of jewelry including, but not limited to, earrings, pendants, pins, bracelets, rings, charms, belt buckles, button caps, cuff links and barretts. The housing shown in FIGS. 1–4 could be used as an earring, necklace, pin or charm depending on the type of fastener used. The batteries could alternately be positioned in other jewelry wherein clearance from the ear is not a design criteria.

Figure 5:
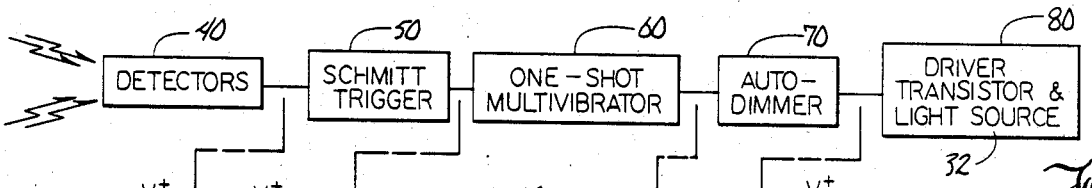
FIG. 5 is a block diagram of the circuit for a preferred embodiment of the invention.

The preferred embodiment for the circuit of the invention is illustrated in basic block form in FIG. 5 as including ambient light sensors 40 from which an irregular output signal is sent to a Schmitt trigger 50 which modifies the signal to a one-shot multi-vibrator 60. The multi-vibrator 60 produces a random pulse signal which coacts with an auto-dimer 70 to activate the driver transistor 80 and light source 32 on the jewelry.

Figure 6:
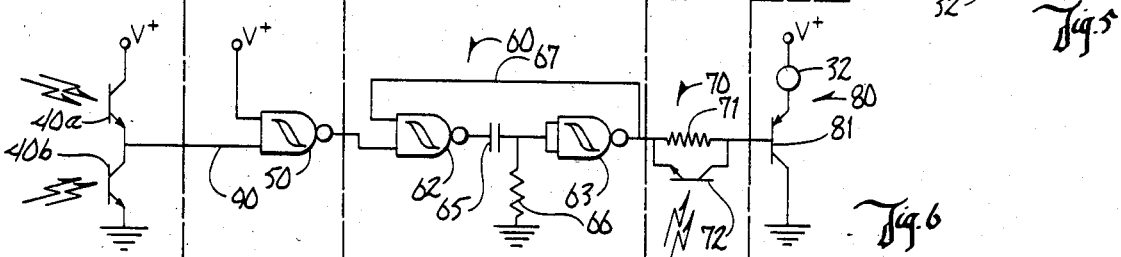
FIG. 6 is an electrical schematic diagram for the circuit of FIG. 5.

A complete electrical circuit diagram is shown in FIG. 6. The individual circuit elements are described as follows.

The light sensors 40 consists of two phototransistors **40*a* and 40*b*** connected in series and physically oriented to sense light from different directions as the wearer of the jewelry moves.

Whereas, "light" is ordinarily construed as that radiation which is capable of effecting the retina of the human eye, it is used herein to also include infrared radiation. Accordingly, the light sensors may be of various types including infrared detectors, photodiodes and FOTOFETS.

The best way to understand the operation of the phototransistors **40*a* and 40*b* is to think of them as light sensitive variable resistors. As the light intensity on the phototransistor increases, its resistance decreases, and as the light intensity decreases, its resistance increases. If the light intensities on both phototransistors are equal or near equal, the resistance will also be equal or near equal, and the output signal will be equal to about one-half the voltage of the battery supply. If the light intensity is low (higher resistance) on sensor 40*a* and high (lower resistance) on sensor 40*b*, the output signal will be of lower voltage. On the other hand, if the light intensity is high (lower resistance) on sensor 40*a* and low (higher resistance) on sensor 40*b***, the output signal will be of higher voltage.

An important feature is the fact that as the light intensities on the phototransistors change, the output voltage will range from near zero to near the voltage of the battery supply thus making the photo-input circuit very sensitive.

Figure 7:
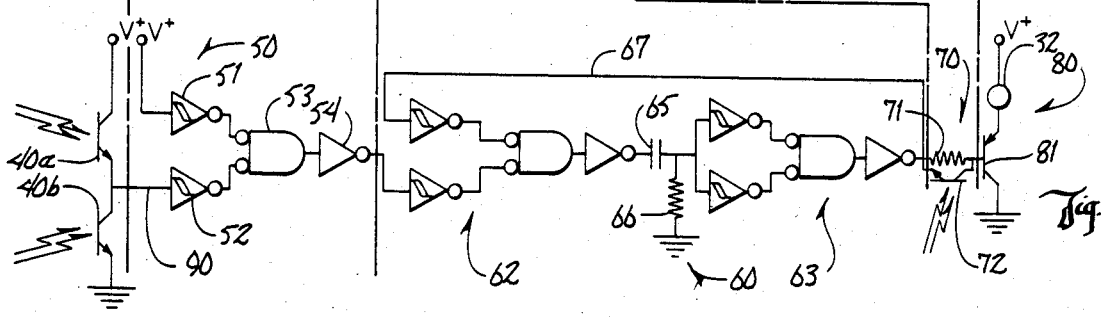
FIG. 7 is a more detailed electrical schematic diagram of the circuit of FIG. 5.
Figure 8:
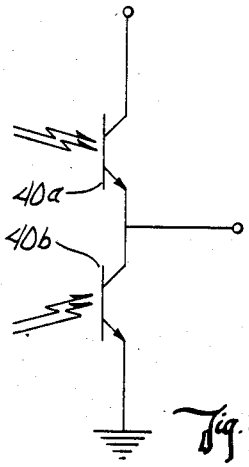
FIG. 8 is an enlarged detail view of the pair of light sensors of the invention.

The Schmitt trigger 50 is indicated by a general symbol in FIG. 6 and in further detail in FIG. 7. Both figures are electrically equivalent and differ only in that FIG. 7 shows the subcomponents, i.e. 51, 52, 53 and 54, of each of the 2-Input Schmitt Trigger NAND Gates. Some electronic component manufacturers such as National Semiconductor show only the general symbol of FIG. 6, while other companies such as Motorola show both the general symbol and subcomponent equivalent of FIG. 7.

The three gates 50, 62 and 63 and a fourth are packaged in a rather common integrated circuit known as the 4093B, Quad 2-Input Schmitt Trigger NAND Gate, which is manufactured by many companies including Motorola, National Semiconductor and Sygnetics. Another common integrated circuit which can substitute for the 4093B but which lacks the advantage of the Schmitt Trigger inputs is the 4011B, Quad 2-Input NAND Gate.

Figure 9:
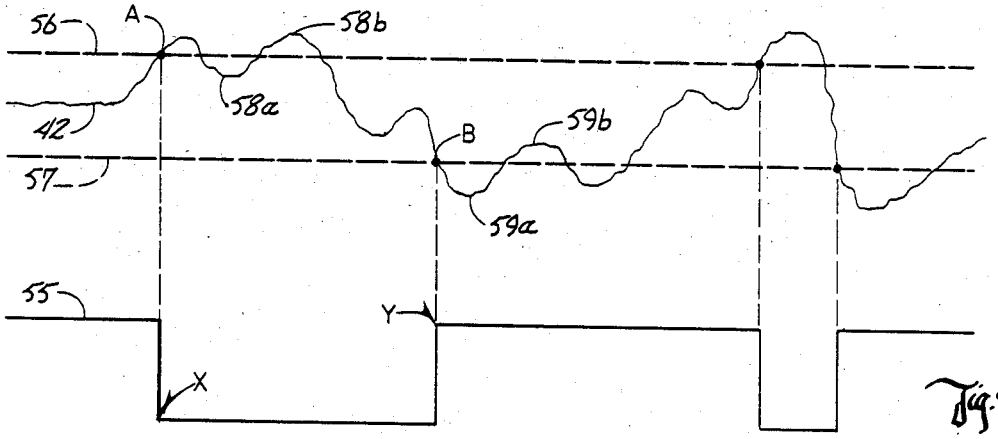
FIG. 9 is a graph showing the relationship between the output of the light sensors and Schmitt trigger.

The function of the Schmitt Trigger 50 is to take in an irregular rising and falling signal 42 from the light sensors 40 and reshape it into a sharply falling and rising wave-forn 55 as shown in FIG. 9. This sharply falling and rising wave-form 55 insures that the light emitter 32 will emit one distinct pulse or a series of distinct pulses, rather than pulses that run into each other and make the light emitter 32 appear to be continuously on for too long a time. The Schmitt Trigger 50 also isolates the light sensors 40 from three one-shot multi-vibrator 60 so that the operation of the sensors 40 does not interfere with the operation of the latter. Note that the Schmitt Trigger can be eliminated and the total circuit will still operate, although somewhat erratic; e.g., the light source will be on for a longer time than desired under some light conditions.

In the graph of FIG. 9, the vertical axis designates voltage and the horizontal axis designates time. As the input signal 42 crosses the upper threshold 56 of the Schmitt Trigger at A, the output wave-form 55 goes low (near zero voltage) at X, and when the input signal 42 falls below the lower threshold 57 at B, the output wave-form 55 goes high (near the voltage of the battery supply) at Y. Proper operation of the Schmitt Trigger requires the input signal 42 from the sensors 40 to range above the upper threshold voltage 56 and below the lower threshold voltage 57 of the Schmitt Trigger 50.

It is only the low going portion of the output wave-form 55 at X that triggers the one-shot multi-vibrator. The rest of the output wave-form 55 has no effect on the one-shot multivibrator. When the input signal 42 from the sensors 40 goes below the lower threshold 57 at B, the output 55 goes high at Y and the Schmitt Trigger is reset. After the one-shot multivibrator is triggered at X, the Schmitt Trigger must be reset or else the output of the Schmitt Trigger will stay low and the one-shot multi-vibrator 60 will not be triggered again, even if the input signal from the sensors 40 fluctuates below and above the upper threshold 56 as indicated at 58A and 58B. Likewise, fluctuations of the input signal 42 above and below the lower threshold 57 as at 59A and 59B will have no effect if the Schmitt Trigger has already been reset as at B.

The one-shot multi-vibrator 60 consists of gates 62 and 63, capacitor 65 and resistor 66. The purpose of the one-shot multi-vibrator 60 is to produce one pulse and only one pulse when it is triggered.

The one-shot multi-vibrator is triggered only by the falling edge of the wave-form 55 as at X and all other portions of the wave-form 55 are ignored. Moreover, once the one-shot multi-vibrator 60 is triggered and the charge-discharge cycle of capacitor 65 begins, all low inputs (triggers) are ignored until the cycle has been completed.

The one-shot multi-vibrator 60 operates as follows. Without a trigger applied, the input 55 is normally high, the output is also normally high, and capacitor 65 is initially discharged. When the input signal 55 goes low, as at X, the output of gate 62 will go high, and the capacitor 65 will begin to charge. Because the capacitor is initially uncharged, most of the output voltage from gate 62 appears initially across resistor 66, driving the output of gate 63 low. Coupling of the output back to input, as indicated by line 67, ensures that the output of gate 62 will remain high no matter what the input state is, because gate 62 has one input low. After a period equal to approximately the value of resistor 66 in OHMs times the value of capacitor 65 in farads, capacitor 65 will have charged to the point where the input voltage for gate 63 falls below its threshold and the circuit returns to its initial state.

The desired pulse-width for the light emitter 32 is between about two and ten miliseconds, depending on the brightness of the light emitter.

Figure 10:
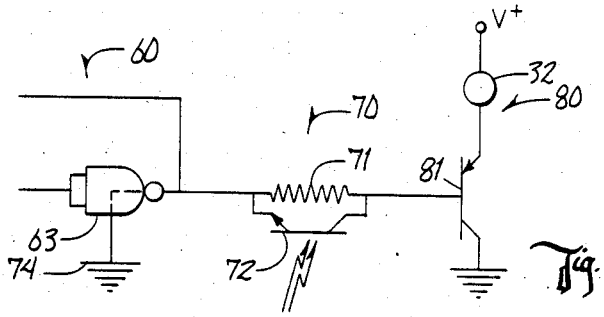
FIG. 10 is an enlarged detail electrical schematic diagram of the auto-dimmer, driver transistor and light emitter.

The auto-dimmer 70 is shown in detail in FIG. 10 and consists of resistor 71 and phototransistor 72 which is the same as that indicated by numeral 34 in FIGS. 1 and 2. The operation of phototransistor 72 can be viewed as a light sensitive variable resistor in parallel with resistors 71. When the ambient light is bright, the resistance of phototransistor 72 becomes lowered and the total resistance of resistor 71 and phototransistor 72 is lowered. This allows more base current to flow when the negative pulse from the multi-vibrator 60 connects the auto-dimmer 70 to ground 74 through gate 63. More current flow in the base 81 of driver transistor 80 allows more current to flow through the transistor 80 and light emitter 32, so the emitted light will be brighter. Conversely, when the ambient light is dim, the auto-dimmer's resistance becomes higher, reducing the flow of base current when the negative pulse is applied. This action also reduces the current flow through the driver transistor 80 and light emitter 32 so the emitted light becomes dimmer. The driver transistor 80 is needed because the gates 50, 62 and 63 of the integrated circuit 4093B cannot conduct sufficient current on a three-volt battery supply.

The physical arrangement of the light sensors 40 as facing in different directions and the electrical connection of the sensors in the circuit are important features of the present invention. The advantages of the configuration of light sensors 40 herein over those commonly found in the field of electronics generally, include (1) greater sensitivity so an amplification stage is eliminated; (2) automatic adjustment to a very wide range of light intensities so the high sensitivity is maintained from very dim light to very bright light; (3) reduced current drain on the battery supply; and (4) effective operation on low voltage battery (three volts or less). Other configurations require higher voltage supplies and/or an amplification stage.

Figure 11:
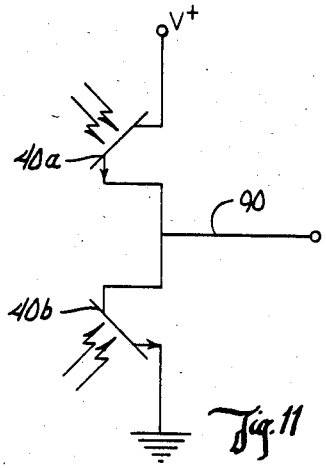
FIG. 11 is an enlarged detail electrical schematic illustration of a pair of phototransistors for producing the circuit input signal.
Figure 12:
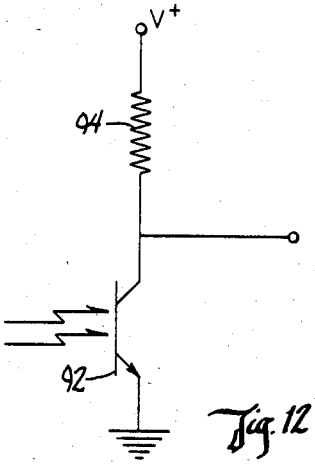
FIG. 12 is a detail electrical schematic diagram of a prior art use of a phototransistor.

The differences between the configuration of detectors herein and other commonly used configurations are illustrated by comparing FIGS. 11 and 12. FIG. 11 illustrates the light sensors 40 of the present invention which are connected in series with the output 90 taken between the two sensors **40*a* and *b*. FIG. 12 illustrates a prior art configuration wherein either a single sensor 92 or a pair of sensors are connected in series with a load resistor 94. The load resistor limits the current through the sensor 92** but also limits the sensitivity of the circuit to the extent that either the voltage supply must be increased; an amplification stage must be added; or more intense light emitters must be added.

Figure 13:
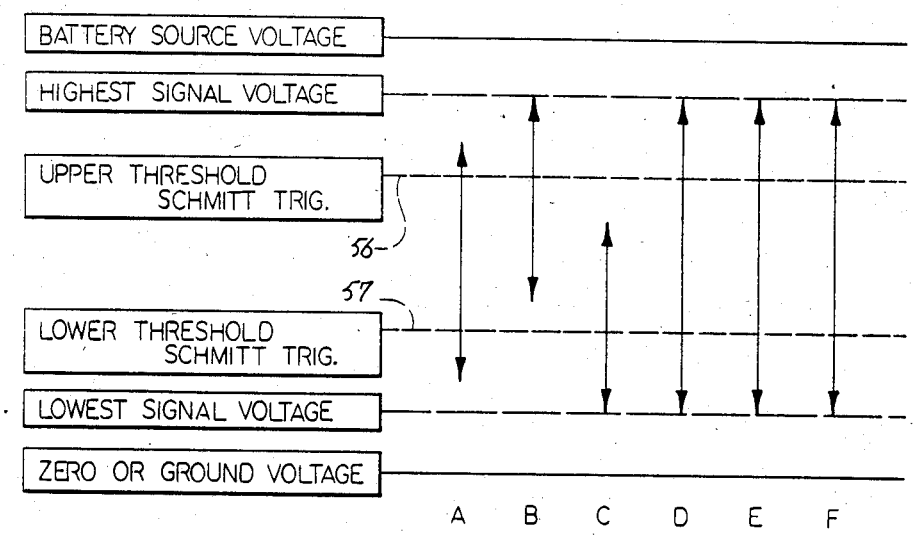
FIG. 13 is a graph illustrating the response of various detectors under conditions of varying ambient light intensity.

The series resistor 94 severely limits performance. Referring to FIG. 13, if the value of the resistor 94 is made about equal to the resistive value of the phototransistor 92 at an average ambient light level, the output signal will range from below the lower threshold 57 of the Schmitt Trigger to above the upper threshold 56 as indicated by arrow A in FIG. 13 and the circuit will operate reasonably well. However, with the same resistor value and dimmer light, the circuit will not operate very well because, referring to arrow B, the signal minimum will generally be above the lower threshold 57 so that the Schmitt Trigger 50 will not be reset. Given the same resistance value in brighter light, the circuit will not operate well because, referring to arrow C, the signal maximum will generally be below the upper threshold 56 of the Schmitt Trigger 50 so that one-shot multi-vibrator 60 will not be triggered. Increasing or decreasing the value of the fixed series resistor 94 will produce the same effect as did dimmer and brighter ambient light. Thus, such a circuit is severely limited to a narrow range of ambient light intensities.

The configuration of light sensors 40 of the present invention overcomes this limitation by substituting a phototransistor in place of the series resistor 94. In effect, this substitution is equivalent to replacing the fixed series resistor with a variable resistor which adjusts to the ambient light intensities. As a result, the configuration of the present invention maintains high sensitivity over a broad range of light intensities as indicated by arrows D, E and F in FIG. 13 which illustrate the signal ranges which correspond respectively to conditions of average light, dimmer light and brighter light.

Whereas a preferred embodiment of the invention has been shown and described, it is to be understood that many modifications, additions and substitutions may be made which fall within the scope of the invention as defined in the appended claims. One alternative is to omit the Schmitt Trigger. This will result in somewhat erratic operation as described above but the circuit will be functional. A second alternative is to omit the auto-dimmer by omitting the phototransistor 72 in the auto-dimmer circuit 70. Thus the light emitter 32 would produce the same brightness regardless of ambient light and may therefore appear artificial at times. A third alternative is to omit both the Schmitt Trigger and auto-dimmer.

A fourth alternative is to replace the one-shot multi-vibrator 60 with another of several different designs of multivibrators and timers. For example, other multi-vibrators are triggered on a rising leading edge pulse. A fifth alternative is to replace the Schmitt Trigger with one constructed from an operational amplifier or NOR gates, instead of NAND gates as described above. A sixth alternative is to replace both the Schmitt Trigger and one-shot multi-vibrator 60 with different designs as are available in integrated circuit form.

Figure 14:
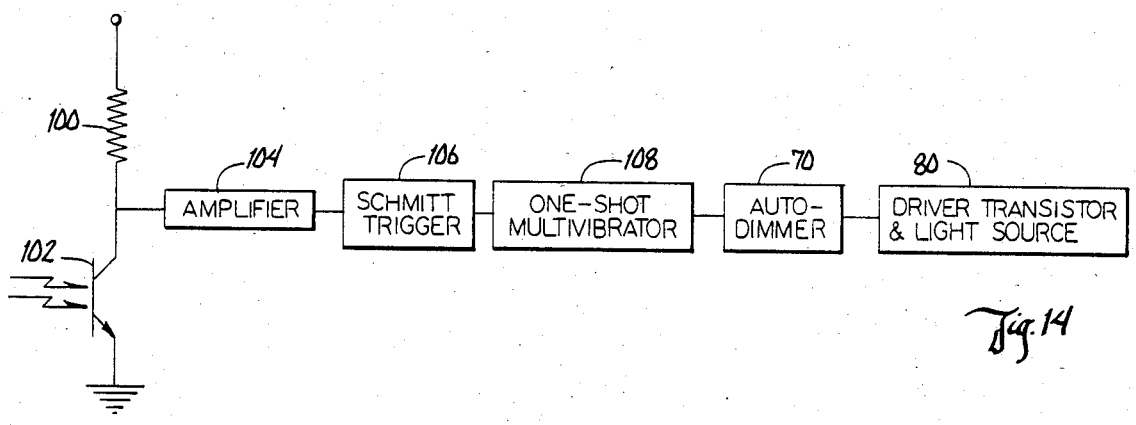
FIG. 14 is a hybrid electrical schematic and block diagram of an alternate embodiment of the invention.
Figure 15:
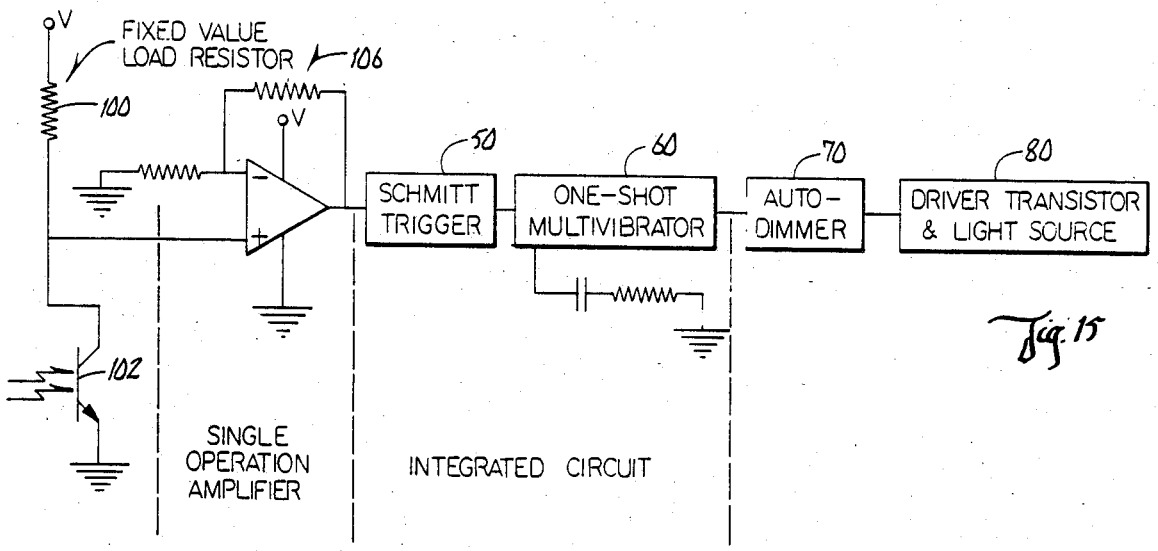
FIG. 15 is another hybrid electrical schematic diagram.

A seventh alternative is illustrated in FIG. 14 wherein a resistor 100 is used in series with a phototransistor 102 for the input and operational amplifiers 104 are used to amplify the input signal and to construct a Schmitt Trigger 106 and one-shot multi-vibrator 108. This combination operates only as well as the preferred embodiment and it can be built by using a Quad Operational Amplifier integrated circuit. Its major drawbacks relate to physical size. The integrated circuit package is a little larger than the 4093B, and most negative, it requires ten additional external resistors and capacitors. The most likely configuration of this circuit is to use a Single Operational Amplifier 106 as indicated in FIG. 15.

Many other modifications of the disclosed embodiment of the invention are possible. For example, the pair of light sensors 40 have been described as being inclined approximately 65° to one another. This angle could vary depending on the type of housing or casing used. The angle could be as much as 180° in some housings so that the invention is intended to include any inclination of between 1° and 180°.

Likewise, whereas specific reference has been made to integrated circuits 4093B and 4011B, thbe invention should not be limited thereto since the circuit thereof, plus most of the external components can be integrated into a single custom package. Such total integration may enable a single 1.5 volt battery to be substituted for the disclosed 3 volt battery source. "Low voltage" is preferably construed as 3 volts or less.

A conventional on-off switch has not been included in the circuit because its physical size would be larger than desired and it is not needed under conditions of normal use, e.g., average indoor lighting. Moreover, placing the jewelry in a dark place such as a drawstring pouch, pocketbook, drawer or jewelry box would have about the same effect as turning the circuit voltage off. However, if the jewelry is left in bright light, the double sensors will have low resistance, draw more current and thereby reduce the life of the batteries. The advantages of an on-off switch would be longer battery life and the ability to turn off the circuit voltage when light emmission was not desired. Accordingly, the invention contemplates the addition of an on-off switch. One possible location for the switch is in a series connection between the battery source and common positive terminal of the integrated circuit.

The logical progression for the total circuitry of the invention is from discrete and integrated circuit components toward a fully integrated circuit. The advantages would be reduced physical size, and reduced power source as mentioned above. Another advantage would be the use of a solid state (electronic) on-off switch which would be as small as the smallest push-switch on a modern digital watch.

Figure 16:
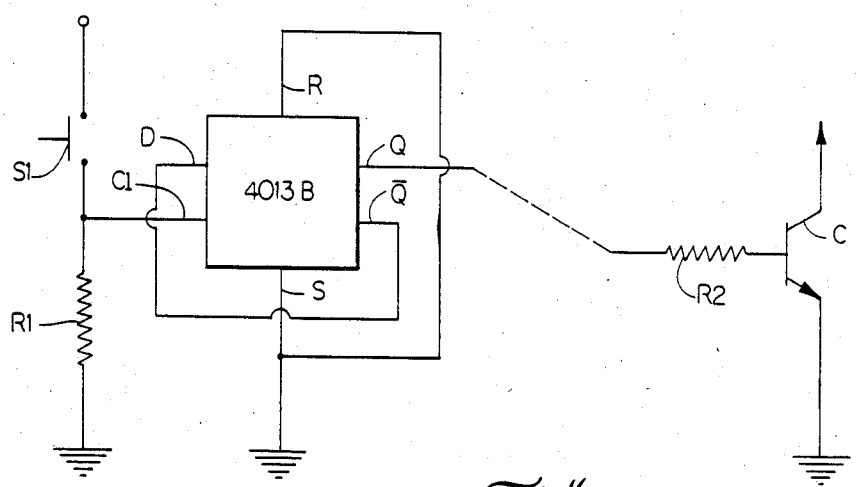
FIG. 16 is an electrical circuit diagram of an optional on-off switch.

FIG. 16 illustrates a block diagram of the integrated circuit for an alternate action switch, push-on, push-off. The integrated circuit is one of two identical circuits housed in the 4013B D-Type Flip Flop with Set and Reset external connections. Several manufacturers produce the identical or equivalent 4013B integrated circuit. Schematic and logic diagrams for the 4013B can be found on pages 5-36 and 5-37 of the CMOS DATA-BOOK by National Semiconductor Corporation, 1981. The 4013B and 4093B integrated circuits can, of course, be combined in a single custom integrated circuit.

When connected as a T Flip Flop as shown in FIG. 16, the circuit can be toggled. Switch S1 is normally open and the output at Q will go high and the circuit is said to be on. Another depression and release of S1 will turn the circuit off.

The output at Q can be used to control the main circuit of FIG. 5 in two ways. One way is to apply the output of Q to the V+ terminals of the sensors 40. This will control the voltage on the sensors and, in turn, the ability of the main circuit to emit light even though voltage is continuously applied to the rest of the circuit. The advantage of this approach is that no additional driver transistor is needed because the current through the sensors 40 is low enough to be handled by the 4013's output Q. Turning off the voltage on sensors 40 will reduce current usage (especially in very bright light) and prolong the life of the batteries. The second method of control is to apply the output from Q to the base of a transistor T1 through resistor R2 as indicated by the dotted line in FIG. 16. The collector C of transistor T1 is connected to the Vss terminal of the 4093 B integrated circuit and thereby controls the voltage to the entire main circuit including the sensors 40 and the light emitter 32.

Thus there has been shown and described improved light-emitting electronic jewelry which accomplish at least all of its stated objects.

I claim:

1. Light-emitting electronic jewelry, comprising, a base item of jewelry, an electrically operated light-emission means on said jewelry, an electrical circuit including means for applying an electrical potential across said light-emission means, thereby to emit light therefrom, a light sensor electrically connected in said circuit, means for mounting said light sensor on said jewelry for sensing ambient light intensity, and circuit element means electrically connecting said light sensor and light emission means, said circuit element means being operative to intermittently interrupt the electrical potential across said light-emission means in response to changes in ambient light intensity sensed by said light sensor.

2. The jewelry of claim 1 further comprising a second light sensor mounted on said jewelry and electrically connected in said circuit.

3. The jewelry of claim 2 wherein said first and second light sensors are connected in series with an output to said circuit element means being taken between said sensors.

4. The jewelry of claim 3 wherein said second light sensor is mounted on said jewelry at an inclination to said first light sensor so that said sensors face different directions.

5. The jewelry of claim 4 wherein said second light sensor is mounted on said jewelry at generally a 65° inclination to said first light sensor.

6. The jewelry of claim 1 wherein said light sensor is selected from the group consisting of phototransistors, photodiodes, FOTOFETS, and infrared detectors.

7. The jewelry of claim 1 wherein said circuit element means comprises a one-shot multi-vibrator operative to produce a narrow pulse at its output in response to a changing signal from said light sensor and switch means for establishing said electrical potential across said light emission means during the narrow pulse output of said one-shot multi-vibrator.

8. The jewelry of claim 7 wherein said switch means comprises a driver transistor electrically interposed between said one-shot multi-vibrator and light emission means.

9. The jewelry of claim 7 further comprising a Schmitt trigger electrically interposed between said light sensor and one-shot multi-vibrator for changing the irregular output signal of the light sensor to a sharply rising and falling signal.

10. The jewelry of claim 9 wherein said one-shot multi-vibrator is triggered by a low wave-form from said Schmitt trigger.

11. The jewelry of claim 7 further comprising an auto-dimmer electrically interposed in said circuit between said one-shot multi-vibrator and said switch means, said auto-dimmer being operative to coact with said switch means for regulating the intensity of light emitted from said light emission means as a function of ambient light intensity.

12. The jewelry of claim 9 further comprising an auto-dimmer electrically interposed in said circuit between said one-shot multi-vibrator and said switch means, said auto-dimmer being operative to coact with said switch means for regulating the intensity of light emitted from said light emission means as a function of ambient light intensity.

13. The jewelry of claim 1 wherein said circuit element means comprises an electronic timer operative to produce a narrow pulse at its output in response to a changing signal from said light sensor and switch means for establishing said electrical potential across said light emission means during the narrow pulse output of said electronic timer.

14. The jewelry of claim 9 wherein said Schmitt trigger comprises a plurality of NAND gates.

15. The jewelry of claim 9 wherein said Schmitt trigger comprises a plurality of NOR gates.

16. The jewelry of claim 9 wherein said Schmitt trigger is constructed from an operational amplifier.

17. The jewelry of claim 1 wherein said circuit element means comprises an integrated circuit element operative to produce random narrow pulses at its output in response to a changing signal from said light sensor.

18. The jewelry of claim 1 further comprising a resistor electrically connected in said circuit in series with said light sensor, an output to said circuit element means being taken between said resistor and light sensor.

19. The jewelry of claim 18 further comprising an amplifier means electrically connected in said circuit for amplifying said output to said circuit element means.

20. The jewelry of claim 1 wherein said electrical circuit further comprises an on-off switch which is operative, in the off condition thereof, to prevent said light sensors from drawing current through said circuit.

* * * * *